US007077769B2

(12) United States Patent
Buschfort

(10) Patent No.: US 7,077,769 B2
(45) Date of Patent: Jul. 18, 2006

(54) ILLUMINATED BALL COVER

(76) Inventor: Carolyn Buschfort, 6530 Ridge Peak, San Antonio, TX (US) 78233

( * ) Notice: Subject to any disclaimer, the term of this patent is extended or adjusted under 35 U.S.C. 154(b) by 39 days.

(21) Appl. No.: 10/848,628

(22) Filed: May 19, 2004

(65) Prior Publication Data

US 2005/0261091 A1 Nov. 24, 2005

(51) Int. Cl.
*A63B 43/06* (2006.01)

(52) U.S. Cl. ..... 473/570

(58) Field of Classification Search ..... 473/570, 473/571, 596–599, 607; 206/315.9, 315.91; 362/103, 108, 154, 156
See application file for complete search history.

(56) References Cited

U.S. PATENT DOCUMENTS 3,351,347 A * 11/1967 Smith et al. ..... 473/570
3,458,205 A * 7/1969 Douglas et al. ..... 473/570
4,776,589 A 10/1988 Yang
4,979,751 A * 12/1990 Sullivan, III ..... 473/570
5,073,844 A * 12/1991 Coyner et al. ..... 362/156
5,102,131 A 4/1992 Remington
5,123,869 A * 6/1992 Schipmann ..... 446/46
5,388,825 A 2/1995 Myers
5,683,316 A * 11/1997 Campbell ..... 473/570
6,384,135 B1 5/2002 Takesue
6,585,390 B1 * 7/2003 Stone et al. ..... 362/156
6,656,066 B1 * 12/2003 Barker ..... 473/570

* cited by examiner

*Primary Examiner*—Steven Wong
(74) *Attorney, Agent, or Firm*—Kammer Browning PLLC

(57) ABSTRACT

An illuminated ball cover generally comprising an inner layer, a concealing layer and an outer layer. The inner layer has a contact side placed over the ball and an upper side. A network of wiring and associated lights are positioned between the inner layer and the concealing layer, wherein the network of wiring is connected to a power source. An outer layer is positioned over the concealing layer and has at least one fastener thereon to allow said cover to surround and be removably fastened to said ball.

10 Claims, 1 Drawing Sheet

ILLUMINATED BALL COVER

CROSS-REFERENCE TO RELATED APPLICATION

N/A

Statements Regarding Federally Sponsored Research or Development

N/A

Reference to a Microfiche Appendix

N/A

BACKGROUND OF THE INVENTION

1. Technical Field

The present invention relates generally to a ball cover, and more particularly to an illuminated cover for a sports or game ball.

2. Background of the Invention

Illuminated balls are well known in the art. The purpose of such balls is to promote nighttime play and prevent any sporting or gaming events from ceasing due to nightfall. Many luminous balls utilize electric lighting assemblies within the ball structure itself.

An example of such a device is found in U.S. Pat. No. 5,102,131 (hereinafter "the '131 patent"). The '131 patent, issued to Remington in 1992, discloses a luminous game ball having portable electric lighting assemblies or chemi luminescent lights, including fireworks inside them for exciting novel effects. Specifically, the '131 patent describes and claims a shaft housing lights therein and being integrally molded into the ball's spherical shape. Further, all electrical connections are mounted near the center of gravity of the ball.

Another example of a luminous ball is depicted in U.S. Pat. No. 5,388,825 (hereinafter "'825 patent"). The '825 patent, issued to Myers in 1995, describes a hollow illuminable ball having a battery, bulb and an on/off switch mounted in its hollow interior with the switch operable by finger of a user.

A further example of a lighted ball is depicted in U.S. Pat. No. 4,776,589 (hereinafter "'589 patent"). The '589 patent, issued to Yang in 1988, discloses a lighted inflatable ball having a hollow compartment of soft PVC membrane being centrally provided in an inflatable ball. Specifically, one end of the hollow compartment is closed and the other end closable by a closure. A battery cell holder with a switch is insertable in the hollow compartment. Wiring from the cell holder passes through the soft membrane layer by means of a blockading member in which the wiring is airtightly fused. The cell wiring is connected to bulb wiring of a plurality of bulbs fixed in projecting rings molded on outer sides of the hollow compartment. However, all of the abovementioned patents fail to disclose a ball having lighting assemblies housed in a cover and capable of being removably attached from the ball structure itself.

In view of the above described deficiencies associated with the use of luminous game balls, the present invention has been developed to alleviate these drawbacks and provide further benefits to a user. These benefits are described in greater detail hereinbelow with respect to several alternative embodiments of the present invention.

SUMMARY OF THE INVENTION

The present invention in its several disclosed embodiments alleviates the drawbacks described above with illuminated ball structures and incorporates additional beneficial features. The present invention described herein is a ball accessory, namely a ball cover, having an inner layer, a concealing layer and outer layer. The concealing layer is placed between the inner layer and the outer layer where a network of wiring and its associated lights is housed therebetween. The ball cover includes two opposing ends where at least one end incorporates an electrical supply source therein. Each of the layers has a lateral opening; and the periphery of the opening of each layer are fastened together to create a unitary cover.

It is therefore a goal of the present invention to provide a removable ball cover which may be retrofitted to an existing ball structure. The ball cover gives the user the option to either play with the ball structure itself or add an illuminated option originating from within the ball cover. The illuminated ball cover may be used to add an aesthetic appeal to the ball and/or allow the user(s) to play a game during the nighttime hours.

An advantage of the present invention is the ball cover has three durable layers which effectively protect and prevent shattering of the network of wiring and associated lights contained therein. The inner layer may include a plurality of suction cups thereby preventing the ball cover from separating from the ball structure during use. The concealing layer is designed to either be opaque thereby hiding the lights and wiring thereunder or may be transparent to draw attention to the electrical components for an aesthetic effect. The present invention may be customized to fit any ball structure and may incorporate any required gaming elements to increase visibility, grip and the like.

Another advantage of the present invention is the ball cover includes a power source located on at least one opposing end of the cover and may be a battery, powered-solar cells and the like. The power source may include an on-off switch for easy manipulation by the user. Further, the present invention may include at least one fastener, whereby the fastener(s) are connected to the wiring and act to close the circuits thereby electrically triggering the lights to come on.

Further advantages of the invention will be more clearly understood from the following description of illustrative embodiments thereof, to be read by way of example and not of limitation in conjunction with the apparatus shown. The beneficial effects described above apply generally to the ball cover disclosed herein. The specific structures through which these benefits are delivered will be described in detail hereinbelow.

BRIEF DESCRIPTION OF THE DRAWINGS

The invention will now be described in greater detail in the following way of example only and with reference to the attached drawings, in which.

MODE(S) FOR CARRYING OUT THE INVENTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention. Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
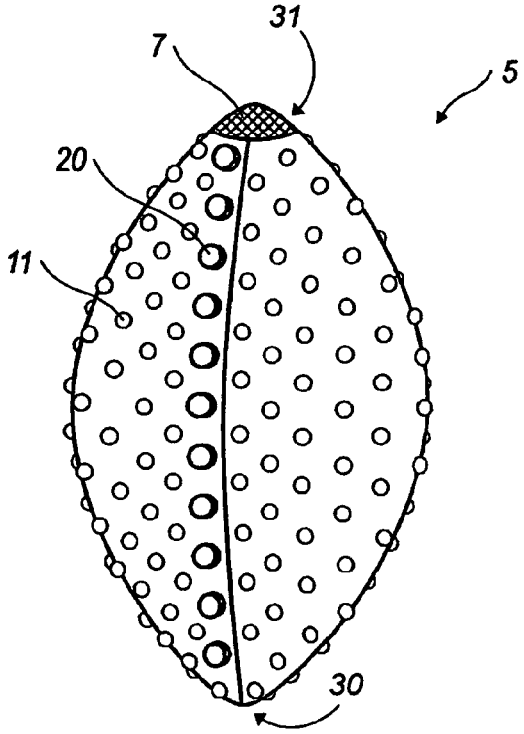
FIG. 1 is a plan view of the present invention.
Figure 2:
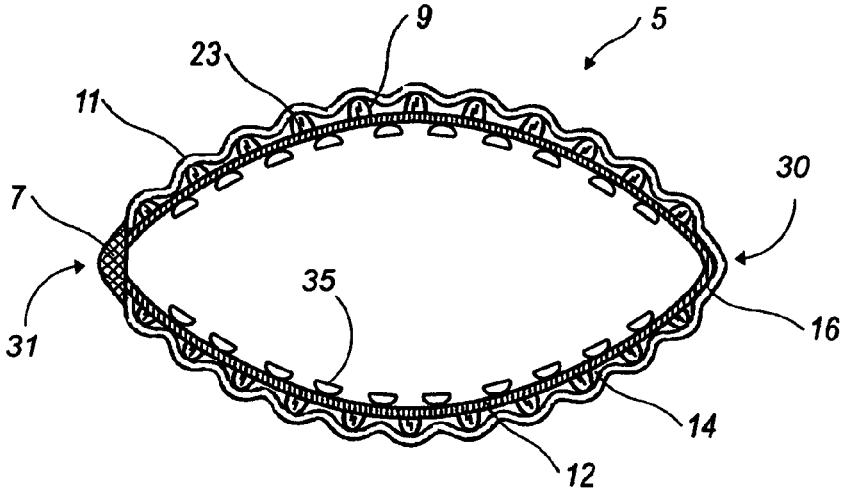
FIG. 2 is a schematical cross-sectional view of the present invention, namely depicting the layers of the present invention.

FIGS. 1 and 2 illustrate a ball accessory, namely a ball cover 5, designed to surround and be removably fastened to a game or sporting ball. Specifically, FIG. 2 shows the ball cover 5 generally having an inner layer 12, a concealing layer 14, and an outer layer 16. Each of the layers 12, 14, and 16 may be configured to fit any ball shape ranging from a pure sphere to a spheroid and the like. Specifically, the inner layer 12 has a contact side and an upper side. The contact side is adjacently positioned to the game or sporting ball and is preferably made of plastic, rubber, resilient foam, thermoplastic resin, poly plastic or any other type of durable cushioned material. Preferably, as shown in FIG. 2, the inner layer 12 may incorporate a plurality of suction cups 35 to provide a non-slip surface and prevent the ball cover 5 from moving and separating from the game or sporting ball.

The concealing layer 14 is placed between the inner layer 12 and the outer layer 16. A network of wiring 23 and its associated lights 9 is housed between the concealing layer 14 and the inner layer 12, namely the upper side of the inner layer 12. The wiring 23 may be made of, but not limited to fiberoptic, chemical, or LED and is connected to the electrical supply source 7.

Preferably, the concealing layer 14 is designed to be opaque in order to hide the network of wiring 23 and its associated lights 9 contained thereunder. The concealing layer 14 may also come in a variety of colors or be transparent for an electrical aesthetic effect. Further, the concealing layer 14 may be made of foam, rubber or other dampening material capable of acting as a shock absorber to protect the network of wiring 23.

The outer layer 16 may be made of plastic, rubber, foam or any material which conforms to the standard gaming or sporting ball. In the most preferred embodiment, the outer layer 16 preferably incorporates standard equipment requirements for each sporting or gaming ball. For example, if the ball cover 5 is to surround a football, the outer layer 16 may include a white ring around each opposing end 30, 31 in order to help players see the ball and its rotation during passing plays. The outer layer 16 may be textured to allow the user to have a firm grip on the ball cover 5; or alternatively, the outer layer 16 may have a smooth external surface to allow for quicker release of the covered ball structure. Further, the outer layer 16 may appear to be textured or having bumps 11; where the bumps 11 are the associated lights housed underneath the concealing layer 14 and bulging therefrom.

As previously mentioned, the ball cover 5 includes two opposing ends, 30 and 31, where at least one end 30 incorporates an electrical supply source 7, including but not limited to batteries, powered-solar cells and the like, therein. Specifically, at least one end 30, is adapted to receive the electrical supply source 7 which may comprise an on/off switch assembly being powered by a battery. The battery has two terminals where one terminals is marked (+), or positive, while the remaining terminal is marked (−), or negative. The terminals may either be positioned on the ends of the battery itself or on lead posts that act as the terminals. A load, namely a plurality of lights, are connected to the battery via a network of wiring 23. The battery may consist of, but not be limited to alkaline, lithium, lithium-ion, nickel-cadmium, nickel-metal hydride, zinc-air and zinc-carbon. The battery may be arranged in a serial arrangement to form higher voltages or preferably in a parallel arrangement to form higher currents.

In the preferred embodiment, the lights 9 are in a parallel arrangement, whereby one end of each light is connected to the positive terminal of the battery and the opposing end of each light is connected to the collector of a transistor. The on-off switch may be depressed to actuate the lights 9 illuminating the ball cover 5. Alternatively, the lights 9 are wired to the negative terminal directly and engage light sockets, where the lights 9 receive their positive flow through the on-off switch being connected to a conductor which is fastened to a holder.

Alternatively, the supply source may come in the form of solar-powered cells, namely photovoltaic cells, in order to be more environmentally friendly when used for more aesthetic purposes, instead of nighttime play when no sunlight is present. The photovoltaic cells maintain its basic structures generally including an anti-revlective coating, a contact grid, N-type silicone, P-type silicone and a back contact. A durable, non-glass cover plate is preferably placed on the antireflective coating in order to protect the solar-powered cells from being exposed to the elements.

In this embodiment, the photovoltaic cells convert the sunlight into electricity by absorbing the light and transferring the energy of the absorbed light to a semiconductor, whereby the energy frees electron-hole pairs. The photovoltaic cells include at least one electric field, thereby forcing freed electrons to migrate in a specified direction. Metal contacts are placed on polar opposite sides of the photovoltaic cell, thereby drawing current away to external use.

Each of the layers 12, 14, 16 has a lateral opening; and the periphery of the each opening of each layer are stitched or otherwise fastened together to create a unitary cover 5. At least one fastener 20 is mounted on the periphery of the lateral openings; and the fastener 20 may be in the form of, but not limited to snaps, hook and loop material such as Velcro™, buttons, zippers and the like. The most preferred embodiment would incorporate snaps as the fastener 20, wherein the snaps would electrically communicate with the network of wiring 23. Operatively speaking, after each male and female connector of each snap are pushed together, the snaps would thereby close the circuits and electrically triggering the associated lights to turn on. When the snaps are pulled apart, the circuit is broken and the lights turn off.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. Therefore, the foregoing detailed description should not be construed as a limitation of the scope of the present invention, which is limited only by the claims appended hereto. The invention is, therefore, claimed in any of its forms or modifications within the proper scope of the appended claims appropriately interpreted in accordance with the doctrine of equivalents.

INDUSTRIAL APPLICABILITY

The present invention finds specific industrial applicability in the toy and sporting industries.

What is claimed and desired to be secured by Letters Patent is as follows:

1. A cover surrounding a ball comprising:

an inner layer having a contact side being adjacently positioned to and closely following the contour of said ball and an upper side;

a concealing layer being positioned over said inner layer;

a network of wiring and associated lights positioned between said upper side of said inner layer and said concealing layer, wherein said network of wiring is connected to a power source;

an outer layer being positioned over said concealing layer; and at least one fastener to allow said cover to surround and closely follow the contour of said ball and be removably fastened to itself.

2. The cover as recited in claim 1, wherein said contact side of said inner layer has a plurality of suction cups thereby preventing said cover from separating from said ball.

3. The cover as recited in claim 1, wherein said contact side is made of a material selected from the group of materials of plastic, rubber, resilient foam, thermoplastic resin and poly plastic.

4. The cover as recited in claim 1, wherein said wiring is made of a material selected from the group of materials of fiberoptic, chemical and light emitting diodes.

5. The cover as recited in claim 1, wherein said concealing layer is made of opaque and transparent material.

6. The cover as recited in claim 1, wherein said associated lights create bumps projecting from underneath said outer layer.

7. The cover as recited in claim 1, wherein said power source is selected from the group of battery or solar-powered cells.

8. The cover as recited in claim 1, wherein said inner, concealing and outer layers are configured to surround any shape of said ball.

9. The cover as recited in claim 1, wherein said at least one fastener is selected from the group of materials including snaps, hook and loop material, buttons and zippers.

10. The cover as recited in claim 1, wherein said at least one fastener comprises a male connector and a female connector each of said connectors being electrically conductive and being connected to said network of wiring thereby turning on said associated lights when said male and female connectors of each of said at least one fastener are connected together.

* * * * *